US007929876B2

(12) United States Patent
Yamagata et al.

(10) Patent No.: US 7,929,876 B2
(45) Date of Patent: Apr. 19, 2011

(54) IMAGE FORMING APPARATUS

(75) Inventors: Kazuhiro Yamagata, Nagoya (JP); Kentaro Murayama, Kasugai (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 286 days.

(21) Appl. No.: 11/935,708

(22) Filed: Nov. 6, 2007

(65) Prior Publication Data

US 2008/0124114 A1 May 29, 2008

(30) Foreign Application Priority Data

Nov. 27, 2006 (JP) ..... 2006-318888
Aug. 16, 2007 (JP) ..... 2007-212311

(51) Int. Cl.
*G03G 15/00* (2006.01)

(52) U.S. Cl. ..... 399/49; 399/72; 399/74

(58) Field of Classification Search ..... 399/38, 399/42, 46–49, 72, 74
See application file for complete search history.

(56) References Cited

U.S. PATENT DOCUMENTS

| | | | | |
|---|---|---|---|---|
| 5,499,079 | A * | 3/1996 | Kinoshita et al. | 399/46 |
| 5,768,671 | A | 6/1998 | Komiya et al. | |
| 6,510,297 | B2 * | 1/2003 | Kawai et al. | 399/74 |
| 6,847,791 | B2 | 1/2005 | Kitagawa et al. | |

FOREIGN PATENT DOCUMENTS

| | | |
|---|---|---|
| JP | 08-044134 | 2/1996 |
| JP | 08-101555 | 4/1996 |
| JP | 2003-098795 | 4/2003 |
| JP | 2003-186280 | 7/2003 |
| JP | 2003-241470 | 8/2003 |
| JP | 2004-093972 | 3/2004 |
| JP | 2005-181974 | 7/2005 |
| JP | 2006-276739 | 10/2006 |

OTHER PUBLICATIONS

Notice for Reasons of Refusal for Japanese Patent Application No. 2006-318888; Mailing Date: Oct. 2, 2008.

* cited by examiner

*Primary Examiner* — David P Porta
*Assistant Examiner* — Benjamin Schmitt
(74) *Attorney, Agent, or Firm* — Banner & Witcoff, Ltd.

(57) ABSTRACT

An image processing apparatus, according to the present invention can include a forming portion capable of forming a mark on a bearing member, a light projecting portion capable of irradiating a light onto the bearing member, a light receiving portion capable of receiving a reflection light from the bearing member and from the mark, and outputs a received light signal in accordance with the received light amount, a judging portion capable of judging the existence or non-existence of a mark on the bearing member based on the received light signal, an evaluating portion capable of evaluating a reflection state of the bearing member and an adjusting portion capable of adjusting a light receiving sensitivity of the light receiving portion at a time of a judgment by the judging portion, in accordance with an evaluation of the evaluating portion.

15 Claims, 15 Drawing Sheets

IMAGE FORMING APPARATUS

CROSS REFERENCE TO RELATED APPLICATION

This application claims priority from Japanese Patent Application No. 2006-318888 filed Nov. 27, 2006 and Application No. 2007-212311 filed Aug. 16, 2007. The entire content of these priority applications is incorporated herein by reference.

TECHNICAL FIELD

The present disclosure relates to an image forming apparatus such as a color laser printer.

BACKGROUND

As an image forming apparatus such as a color laser printer, for example, has applied a method in which a plurality of image forming units are disposed side by side along a belt for conveying sheets, and toner images are transferred in sequence from each image forming unit onto a sheet that is conveyed on the belt. In this kind of image forming apparatus, a technique known as "registration" is employed to prevent the occurrence of a shift (color shift) in the transfer position between each image forming unit.

According to this technique, for example, a predetermined mark is formed on the belt by each image forming unit, a light is radiated onto the belt, and a reflection light therefrom is received by a sensor. The position (existence/non-existence) of a mark is then detected by reading a difference in the reflectance ratios between the belt surface and a mark portion based on the output of the sensor, and correction of a color shift is performed on the basis of that result.

FIG. 13 is a graph illustrating one example of the output of a sensor as described above. In this example, the sensor output increases at a portion M that corresponds to a mark on the belt because the reflectance ratio is low. At a portion B that corresponds to a portion of the belt surface on which a mark is not formed, the sensor output decreases because the reflectance ratio increases. The existence or non-existence of a mark on the belt is determined by comparing the sensor output with a predetermined threshold T1.

However, the surface of a belt sometimes becomes damaged or dirtied accompanying usage. In that case, the reflectance ratio of the belt surface decreases because the light reflects diffusely due to the damage or dirt. As a result, as shown in FIG. 14, there is a risk of the sensor output B from the belt surface increasing to a level that exceeds the threshold T1 such that it will no longer be possible to detect the marks normally.

The conventional technology attempts to solve the above described problem by, for example, changing the threshold to a threshold T2 as shown in FIG. 15. However, in this case, since the difference between the threshold T2 and the sensor output B from the belt surface and the difference between the threshold T2 and the sensor output M from the mark portion respectively decrease, there has been a problem that erroneous detection due to the influence of noise caused by damage or the like on the belt surface is liable to occur.

Because of the above described circumstances, there is a need for technology that can ensure detection accuracy when detecting marks are formed on a bearing member.

SUMMARY

An image processing apparatus, according to the present invention can include a forming portion capable of forming a mark on a bearing member, a light projecting portion capable of irradiating a light onto the bearing member, a light receiving portion capable of receiving a reflection light from the bearing member and from the mark, and outputs a received light signal in accordance with the received light amount, a judging portion capable of judging the existence or non-existence of a mark on the bearing member based on the received light signal, an evaluating portion capable of evaluating a reflection state of the bearing member and an adjusting portion capable of adjusting a light receiving sensitivity of the light receiving portion at a time of a judgment by the judging portion, in accordance with an evaluation of the evaluating portion.

BRIEF DESCRIPTION OF THE DRAWINGS

Illustrative aspects in accordance with the invention will be described in detail with reference to the following figures wherein.

DETAILED DESCRIPTION OF THE PREFERRED ILLUSTRATIVE ASPECTS

An illustrative aspect of the present invention will now be described with reference to FIG. 1 to FIG. 11.

(Overall Configuration of Printer)

Figure 1:
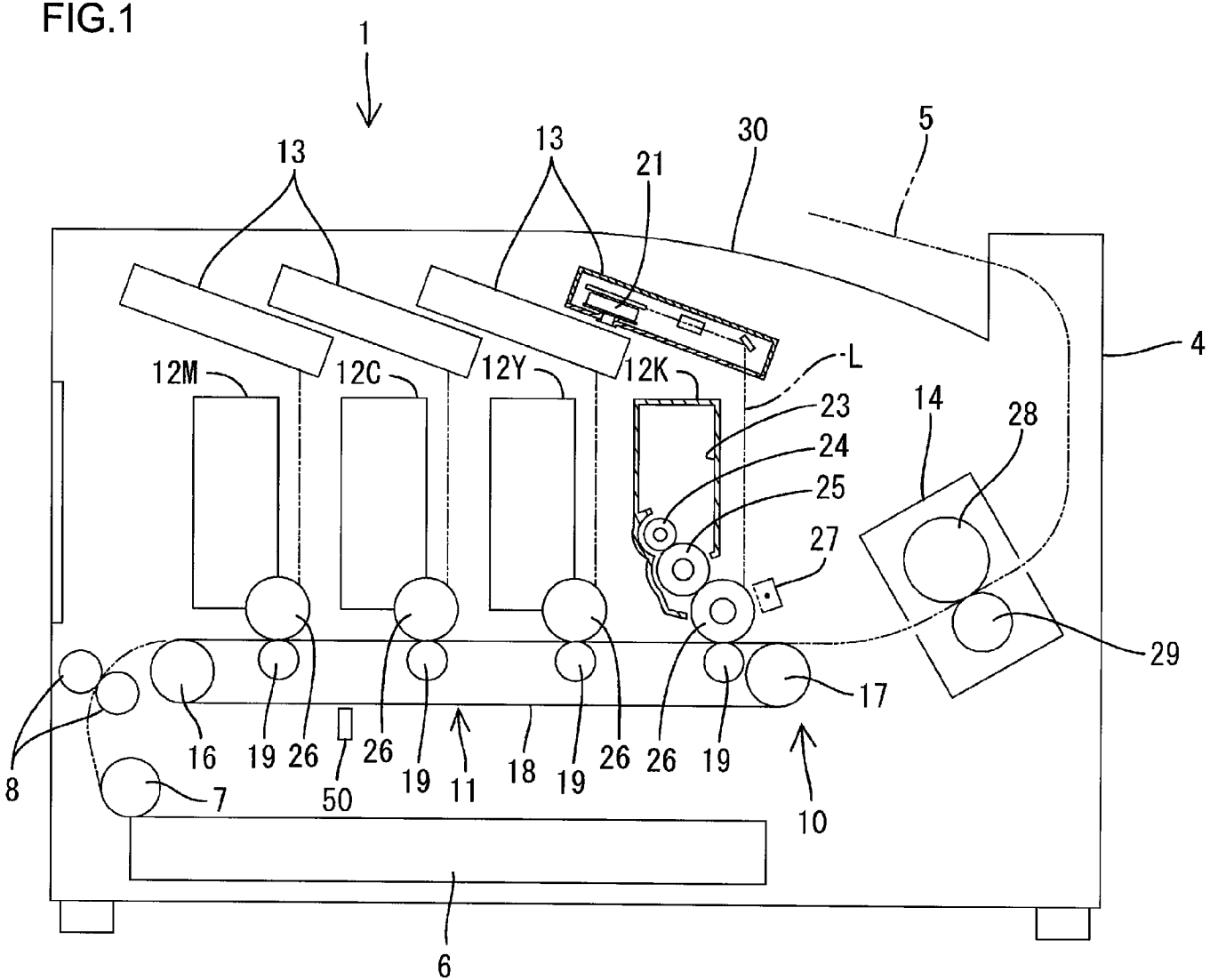
FIG. 1 is a sectional view showing a schematic configuration of a printer according to one illustrative aspect of the present invention.

FIG. 1 is a view that shows the schematic configuration of a printer 1 (one example of "image forming apparatus")

according to the present invention. The printer 1 according to the present illustrative aspect is a color laser printer that can utilize a direct-transfer tandem-type system. In the following description, the left side in FIG. 1 will be referred to as the "front" of the printer 1.

The printer 1 can include a main body casing 4, which can be substantially box-shaped. A sheet supply tray 6 in which a plurality of sheets 5 (such as a paper sheet, plastic sheet, or the like) may be stacked is provided at the inside bottom of the main body casing 4. A sheet feeding roller 7 is provided above the front end of the sheet supply tray 6. By rotation of the sheet feeding roller 7, a single sheet 5 that is stacked in the uppermost position inside the sheet supply tray 6 is delivered to registration rollers 8 that are provided above the sheet feeding roller 7. At the registration rollers 8, the sheet 5 is fed at a predetermined timing onto a belt unit 11 that is disposed to the rear of the registration rollers 8.

An image forming portion 10 (one example of "forming portion") is provided above the sheet supply tray 6 inside the main body casing 4. The image forming portion 10 comprises the belt unit 11, image forming units 12M, 12C, 12Y and 12K, scanner portions 13, and a fixing device 14.

In the belt unit 11, a conveying belt 18 (one example of "bearing member") is provided in a horizontally suspended condition between a pair of supporting rollers 16 and 17 at the front and rear thereof. The conveying belt 18 that can be made of a resin material such as polycarbonate, has a mirror-finished surface. By rotational driving of the belt supporting roller 17 that is disposed at the rear side, the conveying belt 18 is moved in a circulating manner such that the sheet 5 that is placed on the top surface thereof is conveyed rearward. On the inner side of the conveying belt 18, transfer rollers 19 that are disposed facing respective photosensitive drums 26 of the image forming units 12, which will be more fully described later, are provided in a condition in which they are aligned in the front-to-rear direction. Further, on the lower side of the conveying belt 18, a sensor portion 50 is provided for detecting marks of the surface of the conveying belt 18, as described later.

Each of the scanner portions 13 emits a laser beam L that corresponds to one color of respective image data from a light source, and irradiates the laser beam L by high-speed scanning onto the surface of the respective photosensitive drum 26 via a polygon mirror or the like that is rotationally driven by a polygon motor 21.

The image forming units 12M, 12C, 12Y and 12K can respectively include a toner containing chamber 23 that contains toner of different colors (such as magenta (M), cyan (C), yellow (Y), black (K)), a supply roller 24, a developing roller 25, a photosensitive drum 26, a charging device 27 (for example, a scorotron charging device) and the like.

Toner that is discharged from the toner containing chamber 23 is supplied to the developing roller 25 by rotation of the supply roller 24, and at that time, the area between the supply roller 24 and the developing roller 25 is triboelectrically charged positively. Accompanying that rotation, the surface of the photosensitive drum 26 is uniformly charged positively by the charging device 27. Thereafter, the surface is exposed by the laser beam L from the scanner portion 13 to form an electrostatic latent image thereon that corresponds to the image to be formed on the sheet 5. Next, the toner that is carried on the surface of the developing roller 25 is transferred to the surface of the photosensitive drum 26 by the rotation of the developing roller 25, to thereby visualize the electrostatic latent image. Thereafter, the toner image that is carried on the surface of the photosensitive drum 26 is transferred onto the sheet 5 by a transfer bias voltage applied to the transfer roller 19 while the sheet 5 passes between the photosensitive drum 26 and the transfer roller 19.

The fixing device 14 comprises a heat roller 28 that has a heat source, and a pressure roller 29 that presses the sheet 5 to the heat roller 28 side. The fixing device 14 subjects the toner image that is transferred onto the sheet 5 to heat fixing to the sheet surface. The sheet 5 onto which the toner image has been fixed by heating by the fixing device 14 is then conveyed upward to be discharged onto a discharge tray 30 that is provided on the top surface of the main body casing 4.

(Electrical Configuration of Printer)

Figure 2:
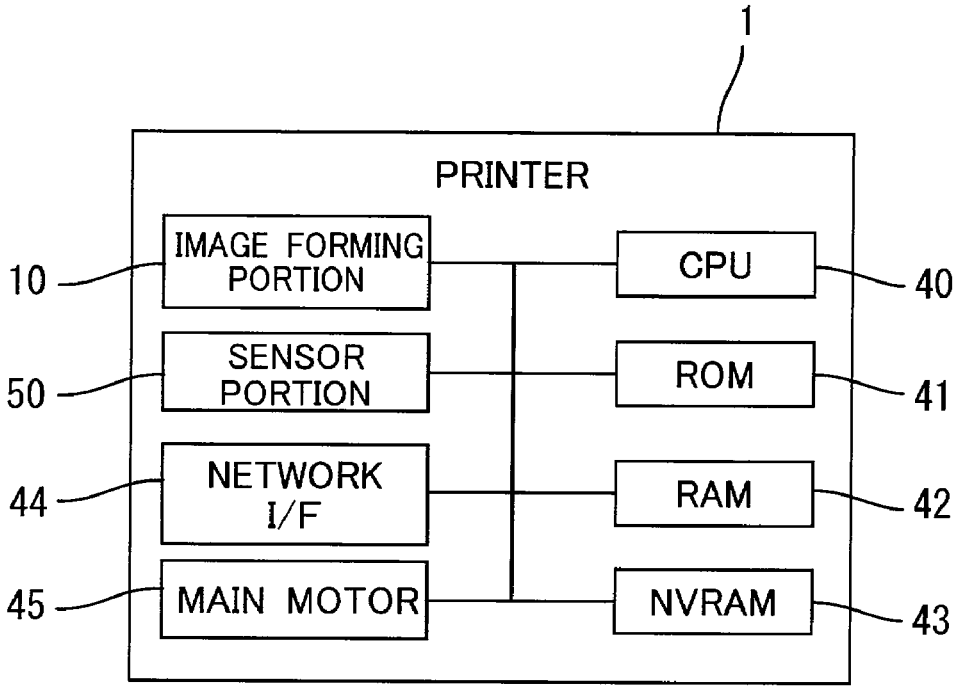
FIG. 2 is a block diagram showing the electrical configuration of the printer in a simplified manner.

Next, the electrical configuration of the printer 1 will be described. FIG. 2 is a block diagram that shows the electrical configuration of the printer 1 in a simplified form.

As shown in FIG. 2, the printer 1 includes a CPU 40, a ROM 41, a RAM 42, a NVRAM (non-volatile memory) 43, a network interface 44 and the like. These components are provided in configuration in which they are electrically connected to a main motor 45 (one example of "driving portion"), the image forming portions 10, and the sensor portion 50, that are described later.

The CPU 40 controls the operations of each portion in accordance with programs stored in the ROM 41 while storing the processing results in the RAM 42 or the NVRAM 43. In this connection, the CPU 40 functions as judging portion, evaluating portion, adjusting portion, and setting portion of the present invention. An information terminal device or the like is connected through a communication line to the network interface 44. The main motor 45 is a motor that drives components such as the aforementioned belt supporting roller 17 and photosensitive drums 26.

(Sensor Portion)

Figure 3:
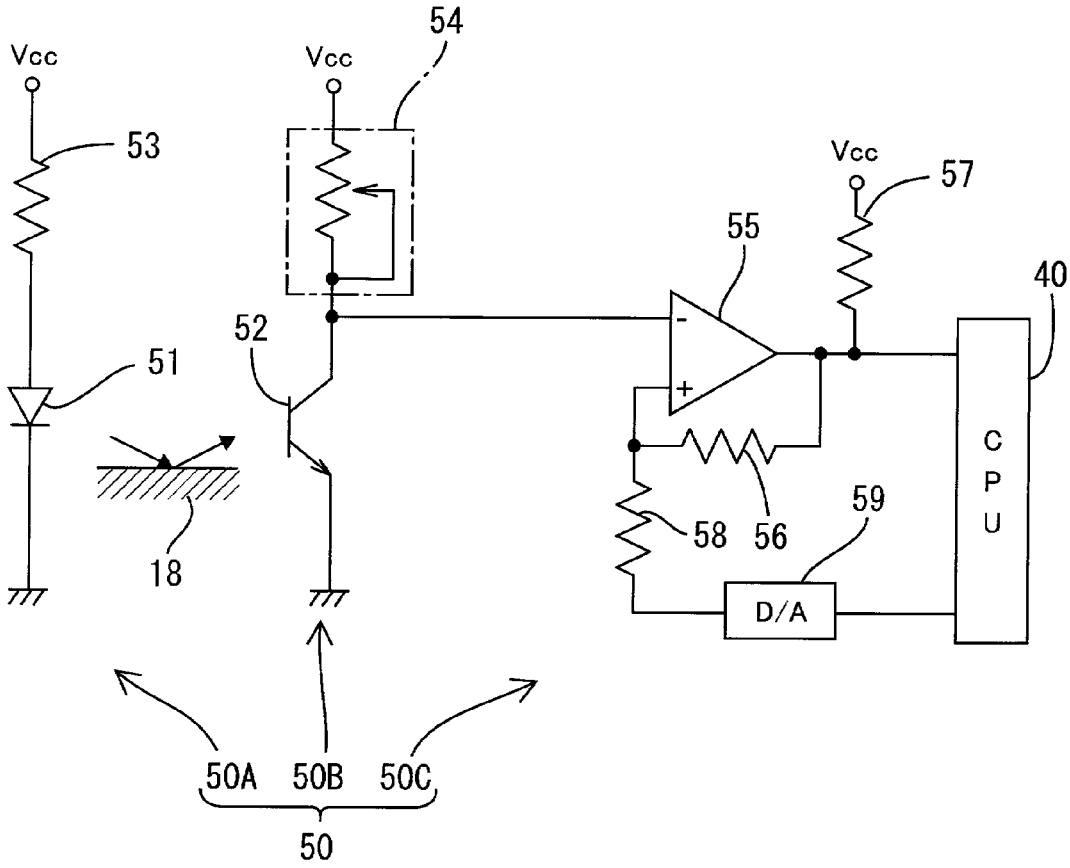
FIG. 3 is a view showing the circuit configuration of a sensor portion.

Next, the circuit configuration of the sensor portion 50 will be described. FIG. 3 is a view showing the circuit configuration of the sensor portion 50. As shown in FIG. 3, the sensor portion 50 comprises a light projecting circuit 50A (one example of "light projecting portion") having a light projecting device 51 that irradiates a light towards the conveying belt 18, a light receiving circuit 50B (one example of "light receiving portion") having a light receiving device 52 that receives reflection light from the conveying belt 18, and a comparison circuit 50C (one example of "comparison portion") that compares the output from the light receiving circuit 50B with a threshold value.

The light projecting circuit 50A has a configuration in which a cathode side of the light projecting device 51 that comprises a LED is grounded, and an anode side is connected to a power supply line Vcc through a resistor 53. When performing registration processing that is described later, upon an instruction from the CPU 40, a constant voltage is applied to the light projecting circuit 50A whereupon the light projecting device 51 emits light of a constant light amount.

The light receiving circuit 50B has a configuration in which an emitter side of the light receiving device 52 comprising a phototransistor is grounded, and a collector side is connected to a power supply line Vcc through a digital potentiometer 54 (one example of "adjusting portion" and "variable resistor"). The output of the light receiving circuit 50B is obtained from the collector of the light receiving device 52. A current in accordance with the received amount of light flows between the collector and emitter of the light receiving device 52.

At the digital potentiometer 54, the resistance value is changed within a predetermined range in accordance with a sensitivity adjustment value that is sent from the CPU 40, in other words, in accordance with a setting value that is written in a register by the CPU 40. More specifically, the digital potentiometer 54 can, for example, change a resistance value to one of 256 levels in the range of 0 to 50 kΩ. A formula that shows the correlation between a setting value applied to the digital potentiometer 54 and the resistance value is stored in the ROM 41. When the resistance value of the digital potentiometer 54 is changed, the sensitivity of the light receiving device 52, i.e. the ratio of a change in the output voltage of the light receiving circuit 50B with respect to a change in a received light amount is changed in accordance therewith.

The comparison circuit 50C comprises an operational amplifier 55, resistors 56, 57, and 58, and a D/A converter 59. The output of the light receiving circuit 50B is connected to a negative input terminal of the operational amplifier 55. An output terminal of the operational amplifier 55 is connected to a positive input terminal of the operational amplifier 55 through the resistor 56. Further, the output terminal of the operational amplifier 55 is connected to the power supply line Vcc through a pull-up resistor 57. The output terminal of the operational amplifier 55 is also connected to the CPU 40. The positive input terminal of the operational amplifier 55 is connected to the CPU 40 via the resistor 58 and the D/A converter 59. Through this configuration, the operational amplifier 55 functions as a hysteresis comparator. More specifically, the operational amplifier 55 compares an output voltage (one example of "received light signal", also referred to hereunder as "sensor output") of the light receiving circuit 50B that is input to the negative input terminal and a threshold value (reference voltage) that is input to the positive input terminal from the CPU 40 via the D/A converter 59 and the resistor 58, and outputs a signal in accordance with the comparison result to the CPU 40.

(Registration Processing)

Figure 4:
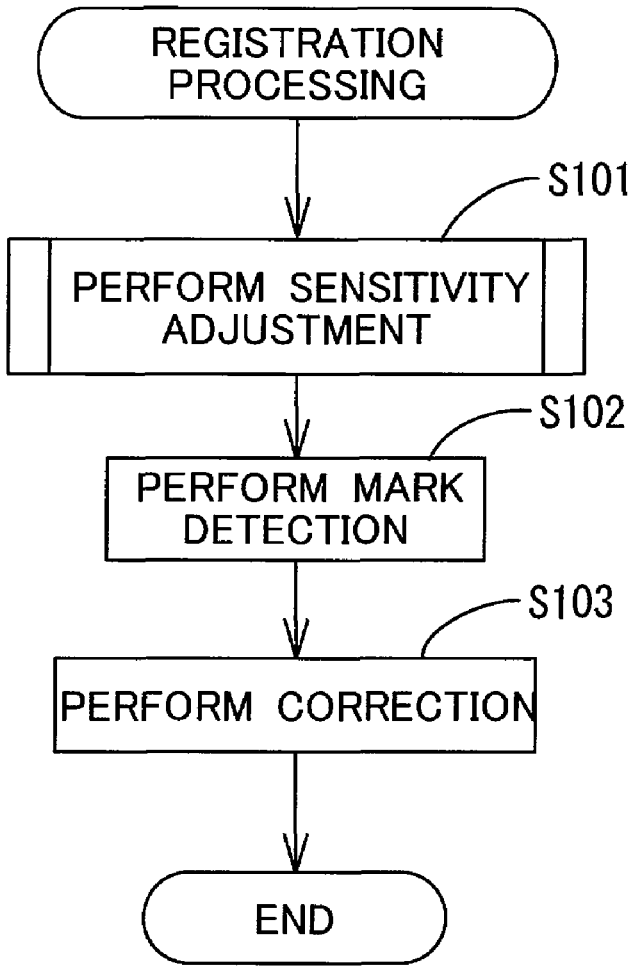
FIG. 4 is a flowchart that illustrates the flow of registration processing.

Next, registration processing that is executed to prevent the occurrence of a color shift is described. FIG. 4 is a flowchart that illustrates the flow of this registration processing. The registration processing is executed when the power of the printer 1 is switched on and the like.

Figure 5:
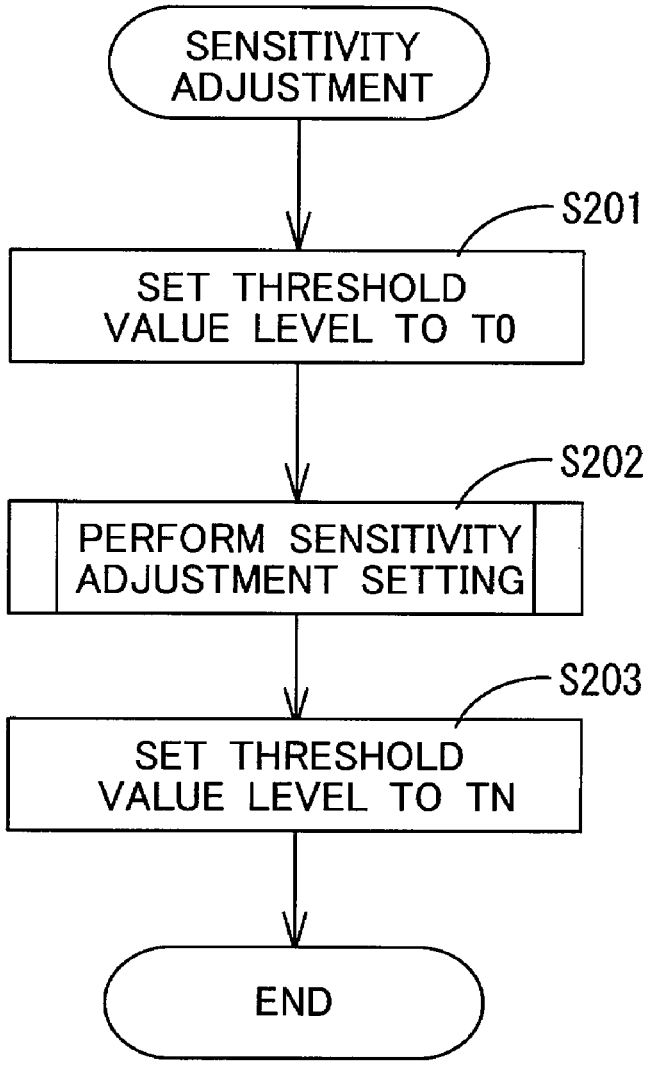
FIG. 5 is a flowchart that illustrates the flow of sensitivity adjustment processing.
Figure 6:
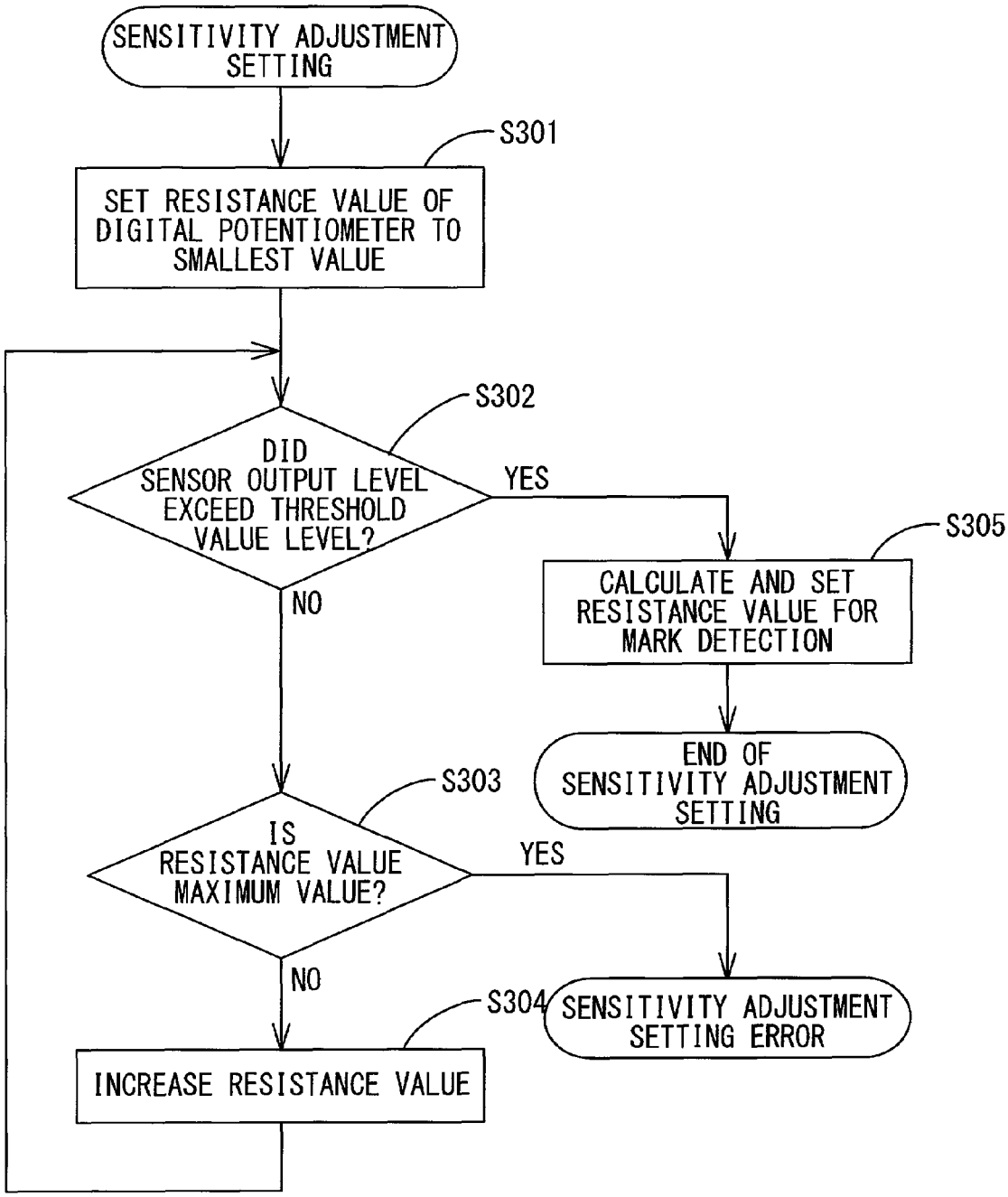
FIG. 6 is a flowchart that illustrates the flow of sensitivity setting processing.
Figure 7:
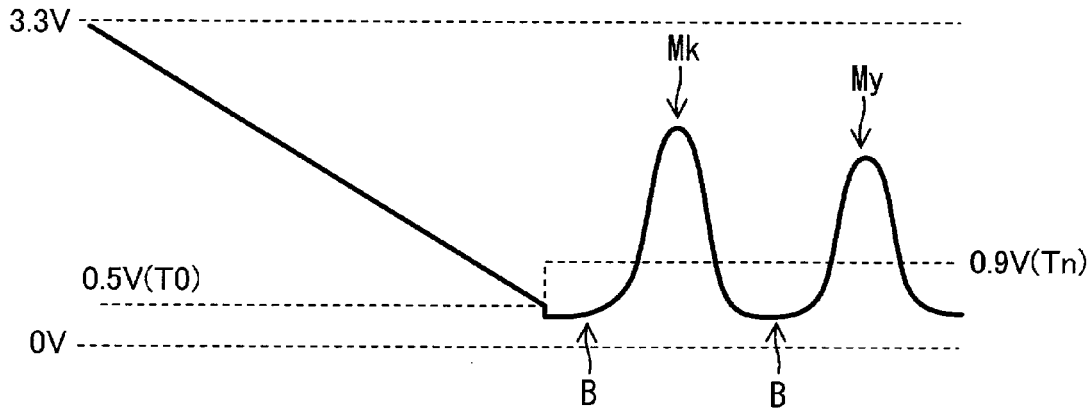
FIG. 7 is a graph that shows one example of a change in an output level at a time of sensitivity adjustment and a time of mark detection.

Upon starting registration processing, the CPU 40 first executes sensitivity adjustment processing (S101). FIG. 5 and FIG. 6 are flowcharts that illustrate the flow of this sensitivity adjustment processing. FIG. 7 is a graph that illustrates one example of changes in sensor output at a time of sensitivity adjustment and a time of mark detection. In this connection, when performing this sensitivity adjustment processing a sensor light is irradiated at a constant light amount from the light projecting device 51 towards the conveying belt 18 that is in a stopped state, and the light receiving device 52 enters a state in which it receives reflection light from the surface of the conveying belt 18.

In the sensitivity adjustment processing, first a threshold value level (reference voltage) that is applied to the operational amplifier 55 is set to T0 (threshold value for sensitivity adjustment (S201). This threshold value level T0 is a value that is slightly higher than the saturation level of the sensor output. More specifically, for example, as shown in FIG. 7, if the saturation level (level in the vicinity of reference character B in FIG. 7) of the sensor output is taken as being 0.3V, a margin of 0.2V is added thereto to set the threshold value level T0 as 0.5V.

Next, the CPU 40 executes sensitivity adjustment setting processing (S202). In this processing, as shown in FIG. 6, first the CPU 40 sets the resistance value of the digital potentiometer 54 to the minimum value within the adjustable range (in other words, the CPU 40 sets the sensitivity adjustment value to the lowest value) (S301). At this time, the sensor output corresponding to a reflection light from the surface of the conveying belt 18 is the same level as a voltage (for example, in FIG. 7, a level of around 3.3V) that is applied to the power supply line Vcc of the light receiving circuit 50B, and becomes a higher value than the threshold value level T0.

Subsequently, the CPU 40 judges whether or not the sensor output level exceeds the threshold value level T0 (S302). More specifically, the CPU 40 judges that the sensor output level exceeds the threshold value level (is less than the threshold value level) when the output from the comparison circuit 50C changes from an L level to an H level. When the sensor output level does not exceed the threshold value level (S302: No), the CPU 40 judges whether or not the resistance value of the digital potentiometer 54 is the maximum value of that adjustable range (in other words, the CPU 40 judges whether or not the sensitivity adjustment value is the highest value in the adjustable range) (S303). If the resistance value of the digital potentiometer 54 is not the maximum value (S303: No), the CPU 40 increases the resistance value by a predetermined amount (more specifically, the CPU 40 increases or decreases the setting value of the digital potentiometer 54 by one) (S304). Accompanying the increase in the resistance value of the digital potentiometer 54, the light receiving sensitivity of the light receiving circuit 50B increases.

Thereafter, the CPU 40 returns to S302 to repeat the processing of S302 to S304 and thereby gradually increase the resistance value of the digital potentiometer 54. The light receiving sensitivity of the light receiving circuit 50B rises accompanying that increase and, as shown in FIG. 7, the sensor output level gradually falls. In a case in which the sensor output level exceeds the threshold value level T0 (S302: Yes), the CPU 40 calculates the resistance value to be used at the next mark detection based on the resistance value of the digital potentiometer 54 at that time, and sets that resistance value in the digital potentiometer 54 (S305).

The method of calculating the resistance value that is set in the digital potentiometer 54 will now be described. A resistance value R that is set in the digital potentiometer 54 is calculated by the following numerical formula 1.

$$R=R0+R1+A/(R0+R1) \quad \text{[Formula 1]}$$

R0 represents the resistance value when it is judged at the aforementioned S302 that the sensor output exceeds the threshold value level T0 (0.5V). More specifically, the resistance value R0 is calculated based on the setting value that is set in the digital potentiometer 54 when the output voltage V exceeds 0.5V. R0+R1, that is obtained by adding R1 to R0, represents a resistance value for lowering the output level of reflection light from the surface of the conveying belt 18 from 0.5V to the saturation level of the light receiving circuit 50B (approximately 0.3V).

In this case, if the voltage applied to the power supply line Vcc of the light receiving circuit 50B is taken as 3.3V, the output voltage of the light receiving circuit 50B is taken as V, the resistance value of the digital potentiometer 54 is taken as R, and the current value is taken as I, the following numerical formula 2 is established on the basis of Ohm's law.

$$V=3.3-IR \quad \text{[Formula 2]}$$

Figure 8:
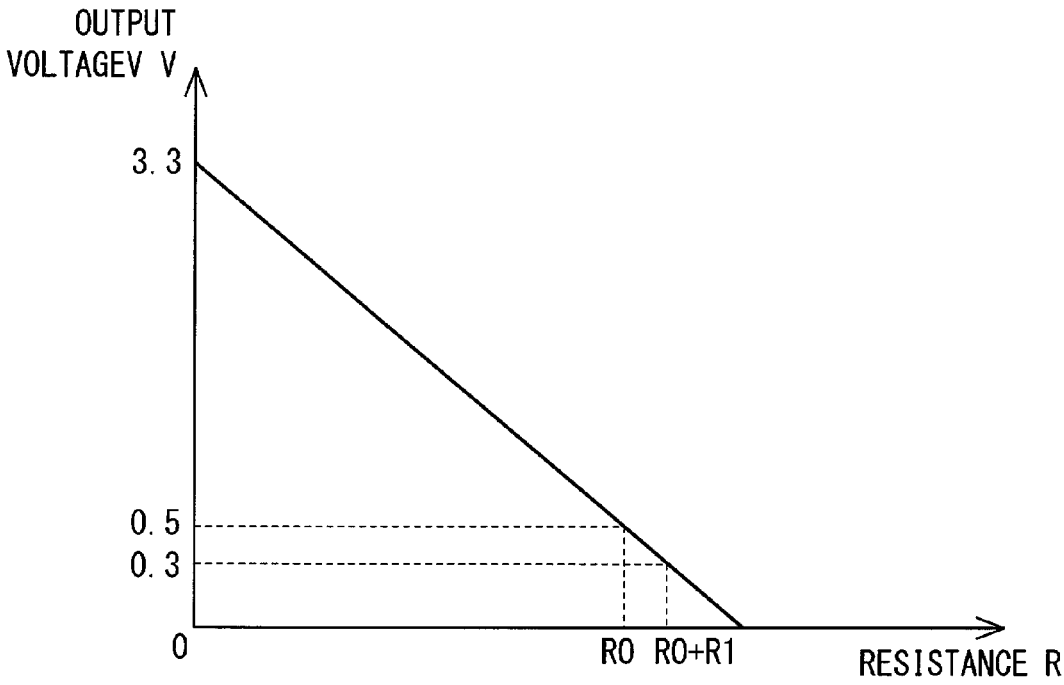
FIG. 8 is a graph that shows the relation between the output voltage of a light receiving circuit that corresponds to a reflection light from the surface of a conveying belt and a resistance value of a digital potentiometer.

FIG. 8 is a graph that illustrates the relation between an output voltage V (the current I is assumed to be constant) of the light receiving circuit 50B corresponding to the reflection light from the surface of the conveying belt 18 and the resistance value R of the digital potentiometer 54. Since the resistance value is R0 when the output voltage V is 0.5V as described above, a resistance value R0+R1 when the output voltage V is 0.3V can be obtained with the following numerical formula 3.

$$R0+R1=(3.0/2.8)*R0 \quad \text{[Formula 3]}$$

Furthermore, A/(R0+R1) of numerical formula 1 is a correction value that is further applied to the value of R0+R1, in which A is a predetermined positive coefficient. Since the value of A/(R0+R1) is in inverse proportion to the value of R0, it is proportional to the size of a current that flows to the light receiving circuit 50B when reflection light is received from the surface of the conveying belt 18. Further, since the value of A is sufficiently large with respect to the value of R0, the greater the amount of received light when the reflection light is received from the surface of the conveying belt 18, the larger the value of R becomes.

The CPU 40 determines the resistance value R as described above, and sets the resistance value R in the digital potentiometer 54. More specifically, the CPU 40 calculates a setting value such that the digital potentiometer 54 will be set to a value that is close to the resistance value R, and sets that setting value in the digital potentiometer 54. Thus, the light receiving sensitivity of the light receiving circuit 50B is set so that the sensor output level is at substantially a saturation level when the light receiving device 52 receives a reflection light from the surface of the conveying belt 18.

Thus, according to the present illustrative aspect, the state (reflectance ratio) of the surface of the conveying belt 18 is evaluated by directly measuring reflection light from the surface of the conveying belt 18 and the light receiving sensitivity of the light receiving circuit 50B is adjusted in accordance with that surface state. In this connection, when the resistance value of the digital potentiometer 54 reaches the highest value in the adjustable range (S303: Yes) before the sensor output level exceeds the threshold value level, the CPU 40 ends the sensitivity adjustment processing and performs error processing.

After ending the sensitivity adjustment setting processing in the manner described above, as shown in FIG. 5, the CPU 40 sets the threshold value level to be used at a time of mark detection to Tn (S203), and ends the sensitivity adjustment processing. The threshold value level Tn is set to be larger than T0 and smaller than an output level (peak value) corresponding to reflection light from marks of each color that are formed on the conveying belt 18. In the example shown in FIG. 7, 0.9V is set as the value for the threshold value Tn by taking a midpoint between the smallest value (around 1.5V) among the values that can be taken as peak values for the output level and the saturation level (around 0.3V).

Figure 9:
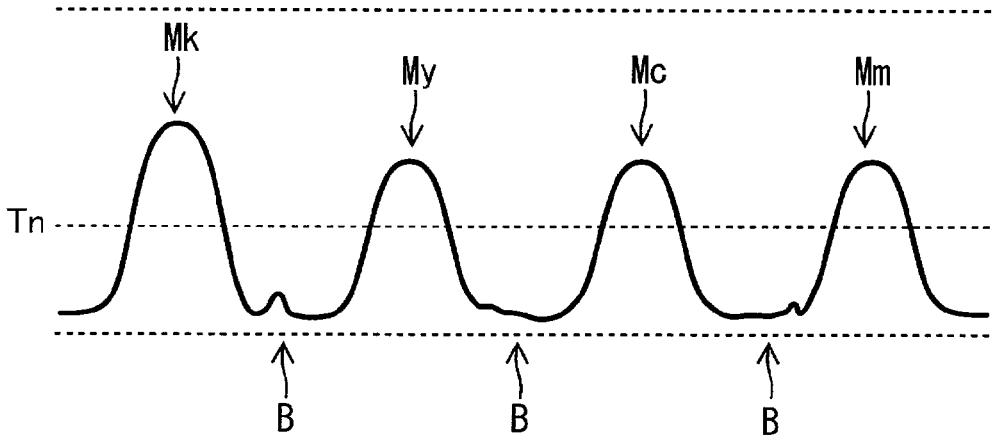
FIG. 9 is a graph showing one example of changes in output levels with respect to mark detection processing.
Figure 10:
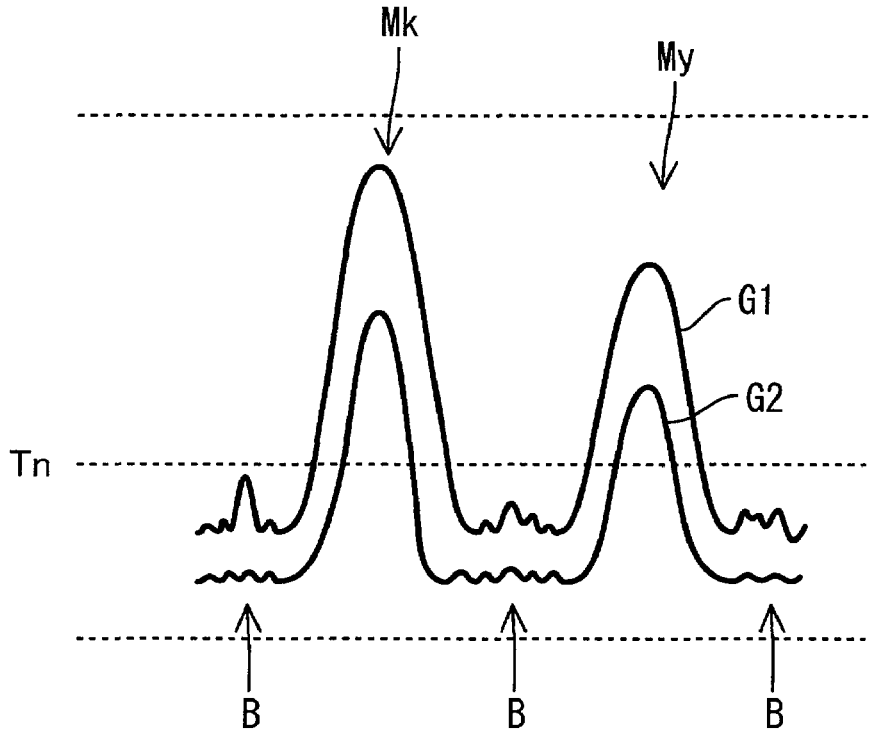
FIG. 10 is a graph showing one example of changes in output levels in a case in which there is a large difference in the amount of reflection light from the conveying belt surface and the amount of reflection light from marks.

Next, as shown in FIG. 4, the CPU 40 drives the conveying belt 18, forms predetermined marks for each color at intervals on the conveying belt 18 using the image forming units 12M to 12K, and performs mark detection processing that detects the positions thereof (S102). FIG. 9 is a graph showing one example of changes in the output levels of the light receiving circuit 50B in this mark detection processing. The output levels are comparatively large values when reflection light is received from mark portions, at which the reflectance ratio is low. In FIG. 9, the sensor outputs Mk, My, Mc and Mm correspond to reflection light from the mark of different colors (such as black, yellow, cyan and magenta, respectively). At sections B that correspond to reflection light from the surface of the conveying belt 18, the sensor output is generally a comparatively small value at the saturation level. In the comparison circuit 50C, a comparison between the sensor output and the threshold value level Tn is performed, and based on the output from the comparison circuit 50C, the CPU 40 determines the positions (existence/non-existence) of marks.

Subsequently, based on the results of mark detection, the CPU 40 corrects the position for writing by the scanner portion 13 of each color with respect to the photosensitive drums 26 (S103). The CPU 40 then ends this registration processing.

In this case, a noise component resulting from damage or dirt on the conveying belt surface may be included in the sensor output from the light receiving device 52. However, as shown in FIG. 9, since the sensor output B corresponding to reflection light from the surface of the conveying belt 18 substantially reaches the saturation level, fluctuations caused by the noise component are suppressed, and the accuracy of the mark detection can be ensured.

Further, according to the present illustrative aspect, since the light projecting device 51 is caused to light at a constant light amount, the configuration of the light projecting circuit is simplified in comparison to a configuration that changes the light amount of the light projecting device. Further, since the light amount is stable, the mark detection accuracy can be ensured.

Next, the effect of performing mark detection using the resistance value R that is determined in the aforementioned numerical formula 1 is described. In a case in which the conveying belt 18 is comparatively new and there is little damage or dirt on the surface thereof, since the reflectance ratio from the surface of the conveying belt 18 is high and the degree of diffusion of the sensor light is low, there is a large difference between the amount of reflection light from the surface of the conveying belt 18 and the amount of reflection light from the mark portions that are received by the light receiving device 52.

Assuming a case in which, for example, in numerical formula 1 the correction value A/(R0+R1) is not added to the resistance value R and the value is made simply R0+R1, since the amount of reflection light from the surface of the conveying belt 18 will be large, the waveform of the output level will also be comparatively large. In this case, on the surface of the conveying belt 18, when the reflectance ratio at a section on which a sensor light is radiated at a time of mark detection (a registration time) is better than at a section on which a sensor light is radiated at a time of sensitivity adjustment, as shown by G1 in FIG. 10, in some cases the output level B corresponding to the reflection light from the surface of the conveying belt 18 may not drop as far as the saturation level. Consequently, the difference between the output level B corresponding to the reflection light from the surface of the conveying belt 18 and the threshold value level Tn decreases. As a result, the light receiving circuit 50B is liable to receive the influence of noise or the like, and it is difficult to ensure the mark detection accuracy.

In contrast, according to the present illustrative aspect, since the amount of reflection light from the surface of the conveying belt 18 that is received by the light receiving circuit 50B is large, a comparatively large correction value is applied with respect to the value of the resistance value R. As a result, the light receiving sensitivity of the light receiving circuit 50B increases, the output level is suppressed to a low level as indicated by G2 in FIG. 10, and the output level B (corresponding to the reflection light from the surface of the conveying belt 18) is substantially the saturation level. It is therefore possible to sufficiently acquire the difference between the output level B corresponding to the reflection light from the surface of the conveying belt 18 and the threshold value level Tn, and the light receiving circuit 50B is no longer liable to be influenced by noise produced by damage or the like on the surface of the conveying belt 18.

In a case in which the conveying belt 18 is old and there is a lot of damage or dirt on the surface thereof, since the degree of diffusion of sensor light increases, the amount of reflection light from the surface of the conveying belt 18 that is received by the light receiving circuit 50B decreases. Furthermore, since diffused light from the surface of the conveying belt 18 is also received when receiving reflection light from the mark portions at the light receiving circuit 50B, the amount of received light increases. As a result, the difference between the amount of reflection light from the surface of the conveying belt 18 and the amount of reflection light from the marks is comparatively small.

Figure 11:
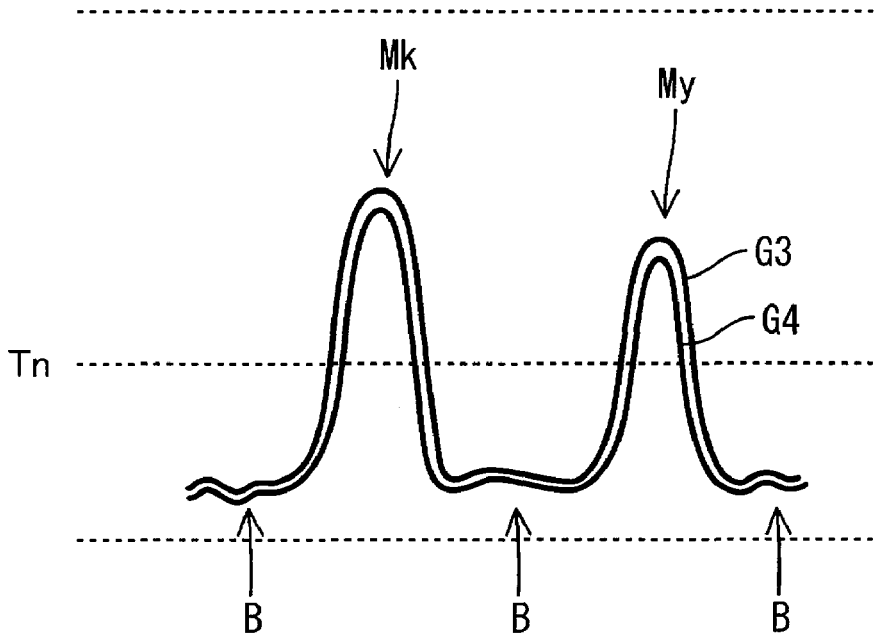
FIG. 11 is a graph showing one example of changes in output levels in a case in which there is a small difference in the amount of reflection light from the conveying belt surface and the amount of reflection light from marks.

Assuming a case in which, in numerical formula 1, the correction value A/(R0+R1) is not added to the resistance value R and the value is made simply R0+R1, since the amount of reflection light from the surface of the conveying belt 18 will be small, for example as indicated by G3 in FIG. 11, the waveform of the output level will also be comparatively small and the output level B corresponding to the reflection light from the surface of the conveying belt 18 will be near to the saturation voltage.

According to the present illustrative aspect, since the amount of reflection light from the surface of the conveying belt 18 that is received by the light receiving circuit 50B is small, a comparatively small correction value is applied with respect to the value of the resistance value R. As a result, the light receiving sensitivity of the light receiving circuit 50B does not become a large value and, as indicated by G4 in FIG. 10, the output level does not change significantly from G3. Consequently, the difference between the threshold value level Tn and the peak values of the output level Mk or My or the like that corresponds to the reflection light from a mark can be maintained to a certain degree.

According to the present illustrative aspect as described above, the light receiving sensitivity of the light receiving circuit 50B is adjusted in accordance with the reflection state of the conveying belt 18. Even when the difference in the reflectance ratio between the surface of the conveying belt 18 and the mark portions is small, by adjusting the light receiving sensitivity the effect of a noise component that is included in the vicinity of the saturation level of the sensor output is reduced. As a result, the mark detection accuracy can be ensured.

The light receiving sensitivity is also adjusted so that the output corresponding to the reflection light from the conveying belt 18 reaches the saturation level. Thereby, the effect of a noise component that gets mixed in with the sensor output due to damage or dirt on the surface of the conveying belt 18 is reduced.

Further, since the reflection state is evaluated by directly referring to the reflection light from the conveying belt 18, the adjustment can be performed with good accuracy.

Furthermore, the light receiving sensitivity is changed in stages, the reflection state of the conveying belt 18 is evaluated on the basis of the light receiving sensitivity when the output level exceeds the threshold value T0 for adjustment, and the light receiving sensitivity at the time of judgment is adjusted based thereon. Accordingly, the light receiving sensitivity is appropriately adjusted.

Further, since the comparison circuit 50C that compares the sensor output level with the threshold value level and the setting portion (CPU 40) that sets the threshold value level can be commonly use when performing sensitivity adjustment (evaluating the reflection state of the conveying belt 18) and judging the existence or non-existence of a mark, a simple configuration can be adopted.

The light receiving sensitivity is adjusted so that the threshold value Tn for judgement is positioned between the output level B corresponding to the reflection light from the conveying belt 18 and the output levels Mk to Mm that correspond to the reflection light from the marks. Accordingly, by comparing the sensor output level and the threshold value level, the existence or non-existence of a mark can be accurately judged.

The threshold value Tn for judgment is positioned between the sensor output level corresponding to the reflection light from the surface of the conveying belt 18 for the sensor output levels corresponding to the reflection light of marks for each color. Accordingly, judgment can be accurately performed even when using marks of a plurality of colors.

Further, the accuracy of judgment can be increased by performing evaluation and sensitivity adjustment with respect to the reflection state of the conveying belt 18 prior to judging the existence or non-existence of a mark.

Furthermore, as the difference between the amount of reflection light from the surface of the conveying belt 18 and the amount of reflection light from the marks increases, the adjustment amount is increased in a direction that widens the difference between the threshold value and the output level of the received light signal that corresponds to the reflection light from the surface of the conveying belt 18. Thus, when a difference in the two light amounts is large, it is possible to suppress the influence of noise components included in the output level corresponding to the reflection light from the surface of the conveying belt 18 when performing mark detection, and as a result the detection accuracy can be increased. Further, when a difference in the two light amounts is small, the difference between the threshold value and the output level corresponding to reflection light from a mark can be maintained by suppressing the adjustment amount.

Furthermore, as the difference between the amount of reflection light from the surface of the conveying belt 18 and the amount of reflection light from the marks increases, the light receiving sensitivity of the light receiving circuit 50B is increased. Thus, when a difference in the two light amounts is large, it is easy for the output level corresponding to the reflection light from the surface of the conveying belt 18 to reach the saturation level, and when performing mark detection the influence of noise components included in the vicinity of the saturation level can be reduced.

Since the light receiving sensitivity of the light receiving circuit 50B is adjusted by setting the resistance value of the digital potentiometer 54, adjustment of the light receiving sensitivity can be implemented with a simple configuration.

Further, the resistance value of the digital potentiometer 54 is changed in stages, and a resistance value of the digital potentiometer 54 for adjusting the light receiving sensitivity is determined based on the resistance value when the output level of the received light signal satisfies a predetermined condition. It is therefore possible to perform accurate adjustment of the light receiving sensitivity.

Furthermore, since the threshold value is adjusted so as to be positioned between an output level of a received light signal that corresponds to reflection light from the surface of the conveying belt 18 and an output level that corresponds to reflection light from marks, the existence or non-existence of a mark can be accurately judged by comparing the output level of a received light signal and a threshold value.

Another illustrative aspect of the present invention will now be described with reference to FIG. 12.

Figure 12:
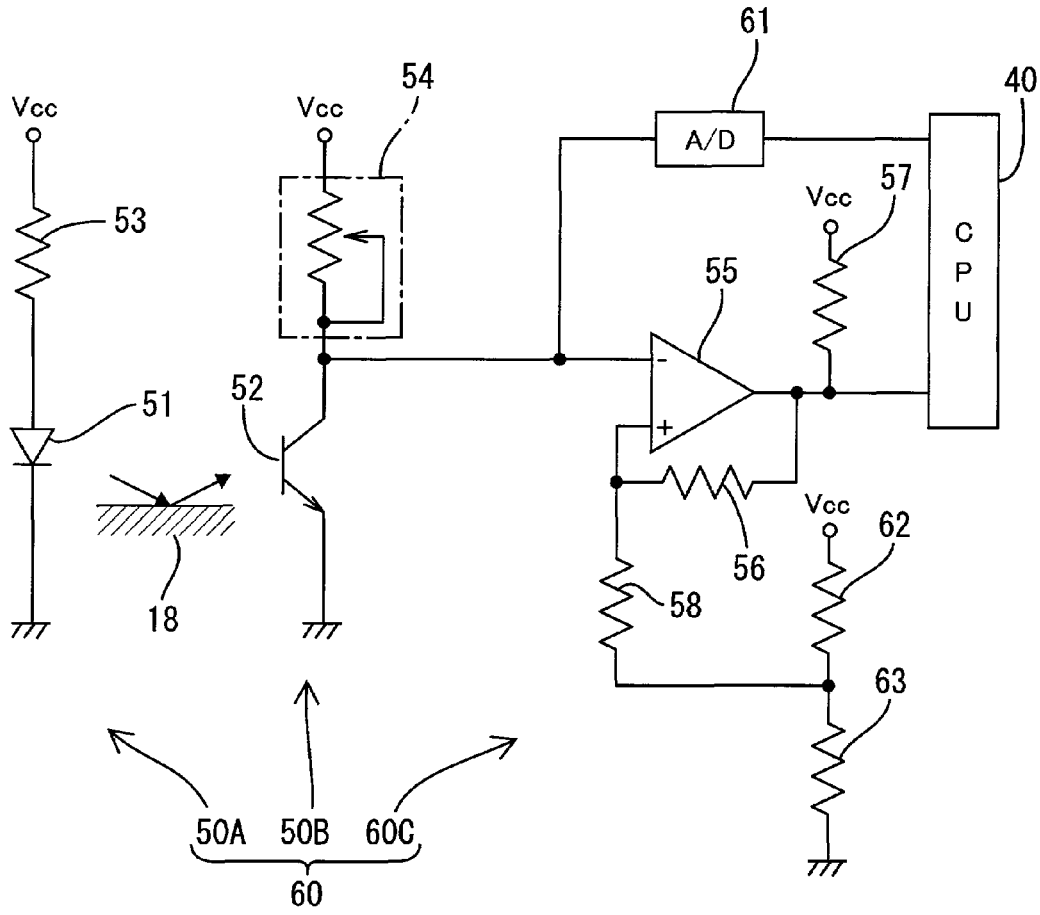
FIG. 12 is a view that illustrates the circuit configuration of a sensor portion according to another illustrative aspect of the present invention.
Figure 13:
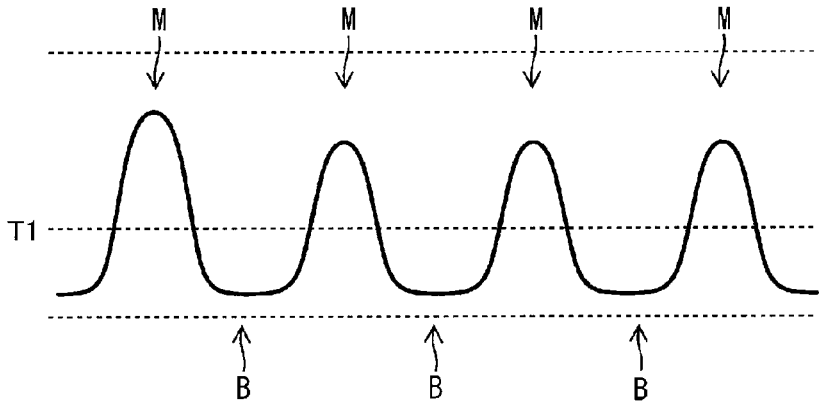
FIG.13 Prior Art
FIG. 13 is a graph showing an example of sensor output according to a conventional example.
Figure 14:
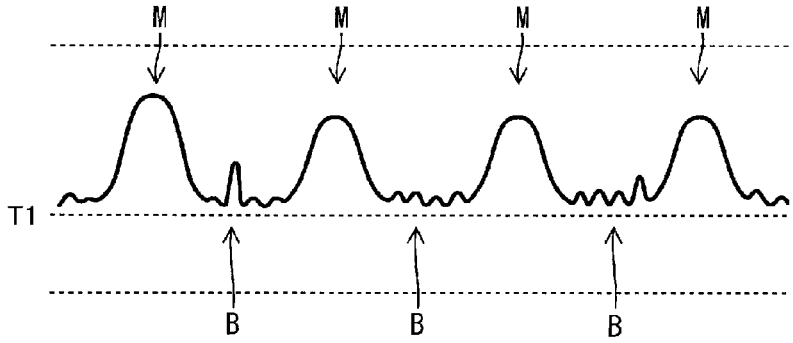
FIG.14 Prior Art
FIG. 14 is a graph showing an example of sensor output according to a conventional example.
Figure 15:
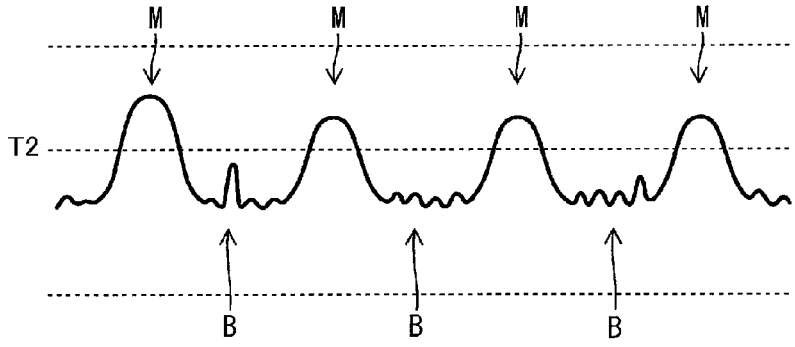
FIG.15 Prior Art
FIG. 15 is a graph showing an example of sensor output according to a conventional example.

FIG. 12 is a view that illustrates the circuit configuration of a sensor portion 60 according to the present illustrative aspect. In the following description, the same reference numerals are assigned to components that are the same as those of the above described illustrative aspect, and a description of those components is omitted.

The sensor portion 60 comprises the light projecting circuit 50A and the light receiving circuit 50B that are similar to the above described illustrative aspect, and also comprises a comparison circuit 60C that is different from the above described illustrative aspect. In the present illustrative aspect, the output from the light receiving circuit 50B is input to the CPU 40 through an A/D converter 61. In the comparison circuit 60C, a part of the voltage that is applied to the resistors 62 and 63 is input to the positive input terminal of the operational amplifier 55 as a threshold value (reference voltage) through the resistor 58. More specifically, according to the present illustrative aspect, the threshold value (threshold value for judgment) of the operational amplifier 55 is a predetermined constant value.

According to the present illustrative aspect, when adjusting the light receiving sensitivity, by directly monitoring at the CPU 40 a sensor output level that is converted into a digital signal by the A/D converter 61, processing that is substantially the same as the sensitivity adjustment setting processing of the foregoing illustrative aspect is performed. Further, when detecting marks, the existence or non-existence of a mark is judged on the basis of the output from the comparison circuit 60C in the same manner as in the foregoing illustrative aspect.

When performing sensitivity adjustment (when evaluating the reflection state of the conveying belt 18) and when judging the existence or non-existence of marks in a manner according to the present illustrative aspect, it is also possible to adopt a configuration that uses separate circuits.

Although according to the above described illustrative aspect a configuration was described that evaluates the surface state of a conveying belt by directly measuring the reflection light, according to the present invention the evaluation may also be performed indirectly based on the amount of driving of the bearing member. For example, a configuration may be adopted in which information relating to the amount of driving of the bearing member such as the usage frequency of the bearing member, the driving time, and the number of print sheets is stored in the NVRAM by the CPU. Thereafter, the surface state of the bearing member may be estimated by referring to that information when executing sensitivity adjustment, and the light receiving sensitivity adjusted in accordance with the estimation result.

It should be noted that although the foregoing illustrative aspects described examples in which the present invention is applied to a direct transfer type color laser printer, the present invention is not limited thereto. For example, the present invention may also be applied to a facsimile machine or a multifunction device that comprises a printer function and a scanner function and the like. The present invention may also be applied to an intermediate transfer type image forming apparatus that uses an intermediate transfer member (intermediate transfer belt or intermediate transfer drum) or to a black and white image forming apparatus.

Although in the above described illustrative aspects, a configuration was described in which a conveying belt is used as a bearing member on which marks are formed, according to the present invention, for example, a photosensitive drum or an intermediate transfer belt can also be used as a bearing member. It is also possible to adopt a configuration in which a mark is formed on a sheet (medium for recording) as a bearing member, and the existence or non-existence of the mark is detected.

Although according to the above described illustrative aspects a configuration was adopted in which the adjustment amount of the light receiving sensitivity is changed, according to the present invention a configuration may also be adopted that changes the adjustment amount of the threshold value. More specifically, a configuration may be adopted such that as a difference between the amount of reflection light from the bearing member and the amount of reflection light from a mark increases, the adjustment amount of the threshold value is increased in a direction which widens a difference between the output level of a received light signal that corresponds to reflection light from the bearing member and the threshold value.

What is claimed is:

1. An image forming apparatus, comprising:

a forming portion capable of forming a mark on a surface of a bearing member;

a light projecting portion capable of irradiating a light onto the surface of the bearing member with light irradiating a portion of the surface of the bearing member with the mark and a portion of the surface of the bearing member without the mark;

a light receiving portion capable of receiving a reflection light from the portion of the surface of the bearing member without the mark and from the portion of the surface of the bearing member with the mark, and outputs a received light signal in accordance with the received light amount;

a judging portion capable of judging the existence or non-existence of a mark on the bearing member based on the received light signal;

an evaluating portion capable of evaluating a reflection state of the bearing member; and an adjusting portion capable of adjusting a light receiving sensitivity of the light receiving portion at a time of a judgment by the judging portion, in accordance with an evaluation of the evaluating portion, wherein the adjusting portion adjusts the light receiving sensitivity such that the received light signal reaches a saturation level, where the received light signal corresponds to a reflection light from the portion of the surface of the bearing member without the mark.

2. The image forming apparatus according to claim 1, wherein the evaluating portion evaluates a reflection state of the bearing member based on the received light signal that corresponds to a reflection light from the bearing member.

3. The image forming apparatus according to claim 1, wherein an evaluation by the evaluating portion and an adjustment by the adjusting portion is added and executed before a judgment by the judging portion.

4. An image forming apparatus, comprising:

a forming portion capable of forming a mark on a surface of a bearing member;

a light projecting portion capable of irradiating a light onto the surface of the bearing member with light irradiating a portion of the surface of the bearing member with the mark and a portion of the surface of the bearing member without the mark;

a light receiving portion capable of receiving a reflection light from the portion of the surface of the bearing member without the mark and from the portion of the surface of the bearing member with the mark, and outputs a received light signal in accordance with the received light amount;

a judging portion capable of judging the existence or non-existence of a mark on the bearing member based on the received light signal;

an evaluating portion capable of evaluating a reflection state of the bearing member; and an adjusting portion capable of adjusting a light receiving sensitivity of the light receiving portion at a time of a judgment by the judging portion, in accordance with an evaluation of the evaluating portion, wherein the evaluating portion evaluates a reflection state of the bearing member based on the received light signal that corresponds to a reflection light from the bearing member, wherein the evaluating portion changes a light receiving sensitivity of the light receiving portion, and evaluates a reflection state of the bearing member based on a light receiving sensitivity when a level of a received light signal that corresponds to a reflection light from the portion of the surface of the bearing member without the mark exceeds a threshold value for adjustment.

5. An image forming apparatus, comprising:

a forming portion capable of forming a mark on a surface of a bearing member;

a light projecting portion capable of irradiating a light onto the surface of the bearing member with light irradiating a portion of the surface of the bearing member with the mark and a portion of the surface of the bearing member without the mark;

a light receiving portion capable of receiving a reflection light from the portion of the surface of the bearing member without the mark and from the portion of the surface of the bearing member with the mark, and outputs a received light signal in accordance with the received light amount;

a judging portion capable of judging the existence or non-existence of a mark on the bearing member based on the received light signal;

an evaluating portion capable of evaluating a reflection state of the bearing member; and an adjusting portion capable of adjusting a light receiving sensitivity of the light receiving portion at a time of a judgment by the judging portion, in accordance with an evaluation of the evaluating portion, a comparison portion capable of comparing a level of the received light signal and a threshold value; and a setting portion capable of setting a threshold value of the comparison portion, wherein the evaluating portion evaluates a reflection state of the bearing member based on the received light signal that corresponds to a reflection light from the bearing member;

wherein the evaluating portion evaluates the reflection state by setting a threshold value for adjustment using the setting portion and performing a comparison using the comparison portion, and the judging portion judges the existence or non-existence of the mark by setting a threshold value for adjustment using the setting portion and performing a comparison using the comparison portion.

6. An image forming apparatus, comprising:

a forming portion capable of forming a mark on a surface of a bearing member;

a light projecting portion capable of irradiating a light onto the surface of the bearing member with light irradiating a portion of the surface of the bearing member with the mark and a portion of the surface of the bearing member without the mark;

a light receiving portion capable of receiving a reflection light from the portion of the surface of the bearing member without the mark and from the portion of the surface of the bearing member with the mark, and outputs a received light signal in accordance with the received light amount;

a judging portion capable of judging the existence or non-existence of a mark on the bearing member based on the received light signal;

an evaluating portion capable of evaluating a reflection state of the bearing member; and an adjusting portion capable of adjusting a light receiving sensitivity of the light receiving portion at a time of a judgment by the judging portion, in accordance with an evaluation of the evaluating portion, wherein the judging portion judges the existence or non-existence of the mark by comparing a level of the received light signal with a threshold value for judgment; and the adjusting portion adjusts the light receiving sensitivity so that the threshold value for judgment is positioned between a level of the received light signal that corresponds to a reflection light from the bearing member and a level of the received light signal that corresponds to a reflection light from the mark.

7. The image forming apparatus according to claim 6, wherein the forming portion forms a plurality of marks of different colors; and the adjusting portion adjusts the light receiving sensitivity so that, with respect to a level of the received light signal corresponding to a reflection light from a mark of any of the colors, the threshold value for judgment is positioned between the level for the relevant mark and a level of the received light signal that corresponds to a reflection light from the bearing member.

8. An image forming apparatus, comprising:

a forming portion capable of forming a mark on a surface of a bearing member;

a light projecting portion capable of irradiating a light onto the surface of the bearing member with light irradiating a portion of the surface of the bearing member with the mark and a portion of the surface of the bearing member without the mark;

a light receiving portion capable of receiving a reflection light from the portion of the surface of the bearing member without the mark and from the portion of the surface of the bearing member with the mark, and outputs a received light signal in accordance with the received light amount;

a judging portion capable of judging the existence or non-existence of a mark on the bearing member based on the received light signal;

an evaluating portion capable of evaluating a reflection state of the bearing member;

an adjusting portion capable of adjusting a light receiving sensitivity of the light receiving portion at a time of a judgment by the judging portion, in accordance with an evaluation of the evaluating portion; and a driving portion capable of driving the bearing member;

wherein the evaluating portion evaluates a reflection state of the bearing member based on a driving amount of the bearing member.

9. An image forming apparatus, comprising:

a forming portion capable of forming a mark on a surface of a bearing member;

a light projecting portion capable of irradiating a light onto the surface of the bearing member with light irradiating a portion of the surface of the bearing member with the mark and a portion of the surface of the bearing member without the mark;

a light receiving portion capable of receiving a reflection light from the portion of the surface of the bearing member without the mark and from the portion of the surface of the bearing member with the mark, and outputs a received light signal in accordance with an amount of the received light;

a judging portion capable of judging the existence or non-existence of a mark on the bearing member based on a comparison between an output level of the received light signal and a threshold value; and an adjusting portion capable of increasing a light receiving sensitivity of the light receiving portion in a direction that widens a difference between an output level of a received light signal that corresponds to a reflection light from the bearing member and the threshold value in accordance with an increase in a difference between an amount of reflection light from the bearing member and an amount of reflection light from the mark, the light receiving sensitivity represents a ratio of a change in an output level of the received light signal with respect to the received light amount, wherein the adjusting portion increases the light receiving sensitivity of the light receiving portion in accordance with an increase in a difference between an amount of the reflection light from the bearing member and an amount of the reflection light from the mark.

10. The image forming apparatus according to claim 9, wherein the adjusting portion adjusts the light receiving sensitivity such that the received light signal corresponding to a reflection light from the bearing member reaches a saturation level.

11. The image forming apparatus according to claim 9, wherein the light receiving portion comprises a light receiving device that receives the reflection light, and a variable resistor that is connected to the light receiving device; and the adjusting portion adjusts a light receiving sensitivity of the light receiving portion by setting a resistance value of the variable resistor.

12. The image forming apparatus according to claim 11, wherein the adjusting portion gradually changes a resistance value of the variable resistor, and determines a resistance value of the variable resistor for adjusting the light receiving sensitivity based on the resistance value when an output level of the received light signal satisfies a predetermined condition.

13. The image forming apparatus according to claim 9, wherein the adjusting portion adjusts so that the threshold value is positioned between an output level of the received light signal corresponding to a reflection light from the bearing member and an output level of the received light signal corresponding to a reflection light from the mark.

14. The image forming apparatus according to claim 9, wherein an adjustment by the adjusting portion is added and executed before a judgment by the judging portion.

15. An image forming apparatus, comprising:

a forming portion capable of forming a mark on a surface of a bearing member;

a light projecting portion capable of irradiating a light onto the surface of the bearing member with light irradiating a portion of the surface of the bearing member with the mark and a portion of the surface of the bearing member without the mark;

a light receiving portion capable of receiving a reflection light from the portion of the surface of the bearing member without the mark and from the portion of the surface of the bearing member with the mark, and outputs a received light signal in accordance with an amount of the received light;

a judging portion capable of judging the existence or non-existence of a mark on the bearing member based on a comparison between an output level of the received light signal and a threshold value; and an adjusting portion capable of increasing the threshold value in a direction that widens a difference between an output level of a received light signal that corresponds to a reflection light from the bearing member and the threshold value in accordance with an increase in a difference between an amount of reflection light from the bearing member and an amount of reflection light from the mark.

* * * * *